US006131011A

United States Patent [19]

Kojima et al.

[11] Patent Number: 6,131,011

[45] Date of Patent: Oct. 10, 2000

[54] METHOD OF ADJUSTING THE MOUNTING OF CLEANING MEMBER, PROCESS CARTRIDGE AND IMAGE FORMING APPARATUS

[75] Inventors: Hisayoshi Kojima, Mishima; Kazunari Murayama, Shizuoka-ken; Tomonori Mori, Numazu, all of Japan

[73] Assignee: Canon Kabushiki Kaisha, Tokyo, Japan

[21] Appl. No.: 09/386,332

[22] Filed: Aug. 30, 1999

[30] Foreign Application Priority Data

Aug. 31, 1998 [JP] Japan ..... 10-245663

[51] Int. Cl.[7] ..... G03G 21/16; G03G 21/00

[52] U.S. Cl. ..... 399/351; 399/111

[58] Field of Search ..... 15/256.5, 256.51; 399/107, 110, 111, 113, 123, 126, 343, 345, 350, 351

[56] References Cited

U.S. PATENT DOCUMENTS

| | | | |
|---|---|---|---|
| 5,235,383 | 8/1993 | Tada et al. . | |
| 5,249,026 | 9/1993 | Kojima . | |
| 5,442,421 | 8/1995 | Kojima . | |
| 5,471,284 | 11/1995 | Fujii et al. . | |
| 5,497,220 | 3/1996 | Inomata et al. . | |
| 5,521,693 | 5/1996 | Kojima et al. . | |
| 5,608,509 | 3/1997 | Shirai et al. | 399/351 |
| 5,682,574 | 10/1997 | Oshida et al. | 399/64 |
| 5,940,657 | 8/1999 | Yokomori et al. | 399/119 |
| 5,950,049 | 9/1999 | Yokomori et al. | 399/119 |
| 5,963,759 | 10/1999 | Kojima et al. | 399/111 |
| 5,966,567 | 3/1997 | Matsuzaki et al. | 399/111 |

*Primary Examiner*—Arthur T. Grimley
*Assistant Examiner*—Hoang Ngo
*Attorney, Agent, or Firm*—Fitzpatrick, Cella, Harper & Scinto

[57] ABSTRACT

In a method of mounting a cleaning member in a process cartridge, the cleaning member to be mounted in the process cartridge has in the opposite ends thereof screw-cramping holes for fixing a supporting plate to the frame of the cartridge, and cut-away portions for fitting and inserting thereinto pins for adjustably moving the supporting plate in a direction for adjustment when the mounting position is adjusted before the supporting plate is fixed to the frame, and during the adjustment of the mounting, the pins are fitted in the cut-away portions and the cleaning member has its mounted position adjusted by the pins being moved, and after the cleaning member has been moved to a predetermined position, the opposite sides of the supporting plate are screw-cramped to thereby effect the positioning of the cleaning member.

6 Claims, 6 Drawing Sheets

METHOD OF ADJUSTING THE MOUNTING OF CLEANING MEMBER, PROCESS CARTRIDGE AND IMAGE FORMING APPARATUS

BACKGROUND OF THE INVENTION

1. Field of the Invention

This invention relates to a process cartridge for use in an image forming apparatus using an electrophotographic method or an electrostatic recording method.

Also, this invention relates to a mounting method of mounting a cleaning member on a cleaning device.

2. Related Background Art

An image forming apparatus, such as a printer, effects selective exposure on an image bearing member, which is an electrophotographic photosensitive member, uniformly charged by a charger to thereby form a latent image, visualizes the latent image with a developer (hereinafter referred to as the toner) by a developing device, and also transfers the toner image to a recording medium and fixes the toner image, thus accomplishing image recording. Any toner remaining on the image bearing member after the transfer is removed by a cleaning blade and the toner is stored in a cleaning container, and the next development is effected on the image bearing member now having a clean surface.

In recent years, it has been put into practice to make the image bearing member, the charger, the developing device, the cleaning device, a box containing waste toner therein, etc. integrally into a cartridge to thereby enable a user to load the main body of the apparatus with the process cartridge, thereby making the interchange of the parts of the image bearing member possible and making maintenance easy. Further, when the life of the image bearing member is extended and the number of printable sheets increases, the developing device, which becomes limited in its supplying capability, is made into an independent unit, and the whole apparatus is divided into a developing unit and an image bearing unit comprising the image bearing member, the charger and the cleaning device made into a unit, thus making the mounting thereof onto the main body of the apparatus and the maintenance thereof easy, and yet the respective main parts have come to be used in conformity to the lives thereof. In this image bearing unit, the waste toner produced by cleaning is stored in a cleaning container of a capacity capable of sufficiently containing the waste toner therein to the end of the life of the image bearing member, and is removed during the interchange of the image bearing unit.

Here, as the cleaning device, use is generally made of a blade member having a supporting portion of a metal plate and an abutting portion formed by an elastic member of rubber or the like, which is adapted to abut against the image bearing member with a predetermined inroad amount to thereby remove the waste toner. If at this time, the aforementioned inroad amount is inappropriate, bad cleaning will be caused or the blade will be torn off and therefore, the aforementioned inroad amount must be kept highly accurate.

In recent years, however, in order to obtain highly accurate images, the particle diameter of the toner tends to become minute, and in order to maintain the cleaning property for this toner, it has become necessary to keep the setting of the aforementioned inroad amount more highly accurate. In such a situation, it has become difficult to cope with the matter by only an improvement in the accuracy of the positioning portion of the cleaning member and a frame supporting and fixing it.

SUMMARY OF THE INVENTION

So, it is an object of the present invention to enable the setting of the inroad amount of a cleaning member relative to an image bearing member to be effected simply and more highly accurately.

The present invention achieving the above object is a method of mounting a cleaning member in a process cartridge, and the cleaning member to be mounted in the process cartridge has a plate-shaped elastic blade which rubs against an electrophotographic photosensitive member mounted on one end of a supporting plate made of a metal, the supporting plate having in the opposite ends thereof screw-cramping holes for fixing the supporting plate to the frame of the cartridge, and cut-away portions for fitting therein pins for adjustably moving the supporting plate in a direction for adjustment when the mounted position is adjusted before the supporting plate is fixed to the housing, and at least one end of the supporting plate has a hole or slit (slot) in which the projection of the cartridge side fits to guide the supporting plate in an adjusting direction, and on the other hand, the frame of the cartridge to which the cleaning member is mounted has, near positions at which the pins are fitted during the above-mentioned adjustment, relieved portions by a space permitting the entry of the pins thus fitted, and a projection corresponding to the location of the above-mentioned hole or slit (slot), and during the adjustment of the mounting, with the projection fitted in the guide hole or slit (slot), the pins are made to abut against the cut-away portions and by the pins being moved, the mounted position of the cleaning member is adjusted, and after the cleaning member has been moved to a predetermined position, the opposite sides of the supporting plate are screw-cramped, whereby the positioning of the cleaning member is effected.

Further, the present invention provides a process cartridge having a cleaning member mounted by such a method, and an image forming apparatus having such a cleaning member.

DESCRIPTION OF THE PREFERRED EMBODIMENTS

Some embodiments of a process cartridge and an image forming apparatus to which the present invention is applied will hereinafter be specifically described with reference to the drawings. In the ensuing description, a color image forming apparatus, on which the process cartridge to which the present invention is applied is detachably mountable, will be exemplified and described.

[First Embodiment]

A color image forming apparatus, on which a process cartridge according to a first embodiment is detachably mountable, will hereinafter be described in detail with reference to FIGS. 1 to 6.

[General Construction of the Image Forming Apparatus]

Figure 1:
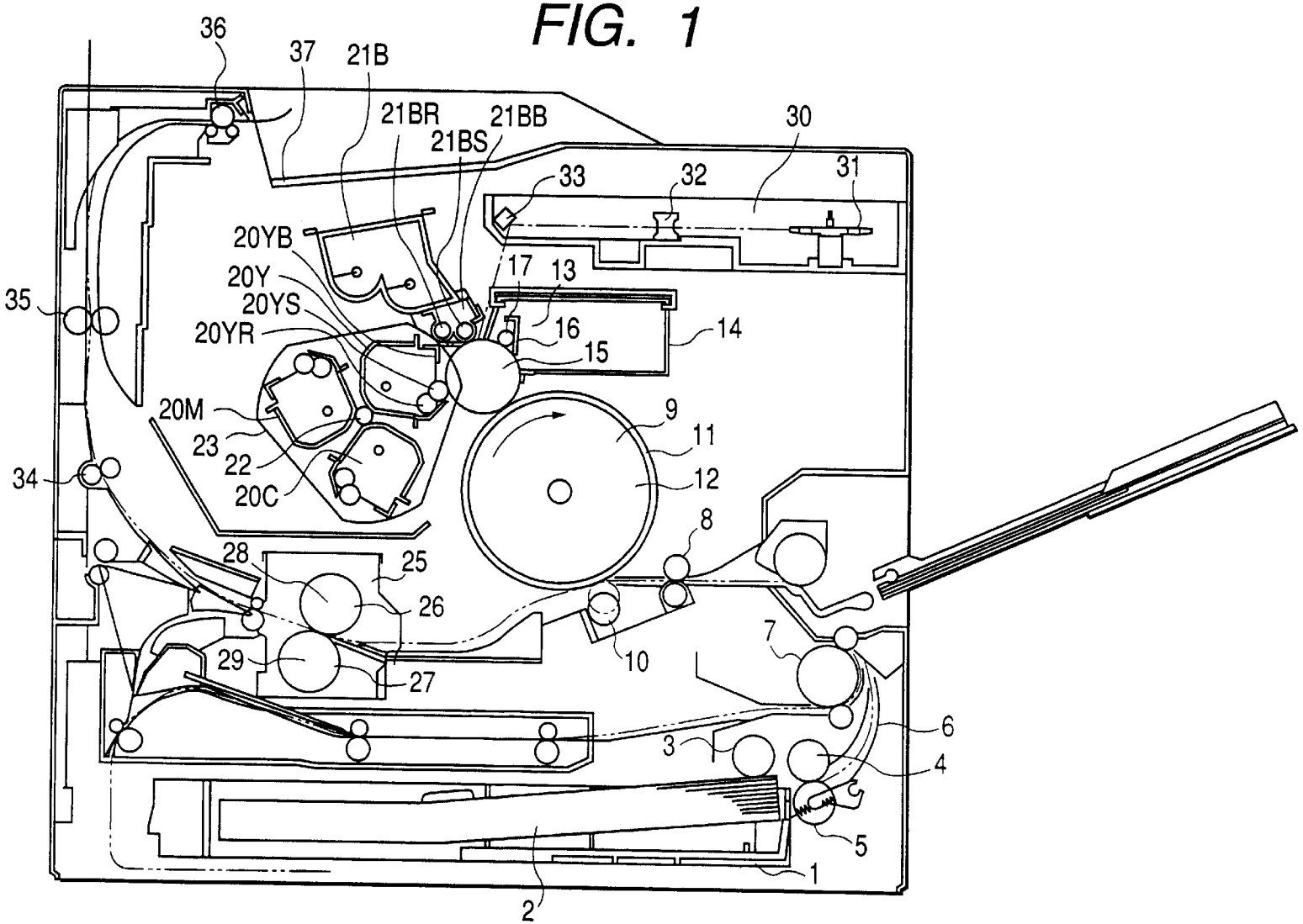
FIG. 1 is a cross-sectional view showing the general construction of a color laser printer which is one aspect of a color image forming apparatus.

The general construction of the color image forming apparatus will first be schematically described with reference to FIG. 1. FIG. 1 is an illustration of the general construction of a color laser printer which is an aspect of the color image forming apparatus.

The image forming portion of the color laser printer is comprised of an image bearing member (electrophotographic photosensitive drum) 15 rotatable at a predetermined speed, a stationary black developing device 21B, and three rotatable color developing devices (a yellow developing device 20Y, a magenta developing device 20M and a cyan developing device 20C).

Below the image forming portion, there is disposed an intermediate transfer member 9 for holding a developed and multi-transferred color image thereon and further transferring it to a sheet-shaped transfer material 2 fed from a feeding portion.

The transfer material 2, to which the color image has been transferred, is then conveyed to a fixing portion 25 to thereby fix the color image on the transfer material 2, and the transfer material 2 is discharged to a discharge portion 37 on the upper surface of the apparatus by discharge rollers 34, 35 and 36.

The rotatable color developing devices and the stationary black developing device are individually detachably mountable with respect to the main body of the printer.

The construction of each portion of the image forming apparatus will now be described in detail.

[Image Bearing Unit]

An image bearing unit (process cartridge) 13 is constructed integrally with the photosensitive drum 15 as an image bearing member and the container 14 of cleaning means serving also as the holder of the photosensitive drum 15. This image bearing unit 13 is supported detachably with respect to the main body of the printer, and is designed to be easily interchangeable in accordance with the life of the photosensitive drum 15.

The photosensitive drum 15 according to the present embodiment comprises an aluminum cylinder having a diameter of about 62 mm and an organic photoconductive layer (photosensitive layer) applied to the outer side of the cylinder, and is rotatably supported on the container 14 of the cleaning means serving also as the holder of the photosensitive drum 15.

A cleaning blade 16 and primary charging means 17 are disposed on the periphery of the photosensitive drum 15, and the driving force of a drive motor, not shown, is transmitted to one end rearward as viewed in FIG. 1, whereby the photosensitive drum 15 may be rotated counter-clockwisely as viewed in FIG. 1 in conformity with the image forming operation.

[Charging Means]

The charging means 17 uses the contact-charging method, and an electrically conductive roller (charging roller) is brought into contact with the photosensitive drum 15, and a voltage is applied to this electrically conductive roller to thereby uniformly charge the surface of the photosensitive drum 15.

[Exposure Means]

The exposure of the photosensitive drum 15 is effected from a scanner portion 30. That is, when an image signal is given to a laser diode, this laser diode applies an image light corresponding to the image signal to a polygon mirror 31.

This polygon mirror 31 is rotated at a high speed by a scanner motor, and the image light reflected by the polygon mirror 31 selectively exposes the surface of the photosensitive drum 15 rotated at a predetermined speed, through the intermediary of an imaging lens 32 and a reflecting mirror 33, and as the result, an electrostatic latent image is formed on the photosensitive drum 15.

[Developing Means]

The developing means is comprised of three rotary color developing units 20Y, 20M, 20C and a black developing unit 21B capable of effecting development of the colors yellow, magenta, cyan, and black to visualize the electrostatic latent image.

The black developing unit 21B is a stationary developing unit, and a developing sleeve 21BS is disposed at a position opposed to the photosensitive drum 15 with a minute interval (about 300 $\mu$m) therebetween, and a developing bias is applied to the developing sleeve 21BS to thereby effect reversal development (jumping development) correspondingly to the electrostatic latent image on the photosensitive drum 15, and the electrostatic latent image is visualized as a toner image on the surface of the photosensitive drum 15.

The toner capacity of the black developing unit 21B, in view of documents and image patterns handled by users and the amount of toner consumption, covers the toner corresponding to 15,000 pages (A4, 5% print), which is double or more of the toner capacities of the other rotary color developing units 20Y, 20M and 20C.

By the black developing unit 21B being thus made large in capacity, the frequency with which the user interchanges the black developing unit 21B can be reduced and it also becomes possible to reduce the running cost per sheet of print.

Also, the black developing unit 21B, as shown in FIG. 1, is disposed intermediately of the scanner portion 30, which is the exposure means and the rotary color developing units 20Y, 20M, 20C, whereby the leaking toners, when the rotary color developing units 20Y, 20M, 20C are rotated, are prevented from scattering even to the optical parts of the scanner portion. Thereby, the toners can be prevented from adhering to the polygon mirror, the imaging lens, the reflecting mirror, etc., to hamper the formation of latent images, and clear-cut output images can be obtained.

Each of the three rotary color developing units 20Y, 20M and 20C includes a toner corresponding to 6,000 pages (A4, 5% print), and is detachably mounted on a developing rotary 23 rotated about a shaft 22.

During image formation, each developing unit is rotatively moved about the shaft 22 while being held on the developing rotary 23, and a predetermined developing unit is stopped at a position opposed to the photosensitive drum 15 and further, is positioned so that the developing sleeve may be opposed to the photosensitive drum 15 with a minute interval (about 300 $\mu$m) therebetween, whereafter a visible image is formed correspondingly to the electrostatic latent image on the photosensitive drum 15.

During the formation of a color image, the developing rotary 23 is rotated for each one full rotation of the intermediate transfer member 9, and the developing step is done in the order of the yellow developing unit 20Y, the magenta developing unit 20M, the cyan developing unit 20C, and the black developing unit 21B.

In FIG. 1, there is shown a state in which the yellow rotary developing unit 20Y is positioned and rests at a position opposed to the image bearing unit 13. The rotary developing unit 20Y is feeding the toner onto a coating roller 20YR by a toner feeding mechanism in the container. The coating roller 20YR, rotated clockwisely as viewed in FIG. 1, and a developing blade 20YB, urged against the outer periphery of a developing sleeve 20YS, apply a thin layer of toner to the outer periphery of the developing sleeve 20YS, rotated clockwisely as viewed in FIG. 1 and impart charges to (triboelectrically charge) the toner.

A developing bias is applied to the developing sleeve 20YS opposed to the photosensitive drum 15 on which the latent image is formed, whereby toner development is effected on the photosensitive drum 15 in conformity with the latent image.

With regard also to the magenta developing unit 20M and the cyan developing unit 20C, toner development is effected by a mechanism similar to what has been described above.

Also, the developing sleeve of each of the rotary color developing units 20Y, 20M and 20C is connected to a high voltage source for each color development and a drive provided in the main body of the printer when each developing unit has been rotatively moved to the developing position, and for each color development, a voltage is selectively applied and the drive is connected.

[Intermediate Transfer Member]

The intermediate transfer member 9, during the formation of a color image, is rotated clockwisely in synchronism with the peripheral speed of the photosensitive drum 15 to receive the multi-transfer of the toner image on the photosensitive drum 15 visualized by each developing unit four times (the images of the four colors Y, M, C and B). Also, the intermediate transfer member 9, which has received the multi-transfer, nips and conveys the transfer material 2 by and between it and the transfer roller 10, to which a voltage has been applied, whereby the respective color toner images on the intermediate transfer member 9 are multi-transferred to the transfer material 2 at a time.

The intermediate transfer member 9 according to the present embodiment is of a construction in which the outer periphery of an aluminum cylinder 12 has a diameter of 186 mm and is covered with an elastic layer 11 of medium resistance sponge, medium resistance rubber or the like. This intermediate transfer member 9 is driven and rotated by a gear (not shown) rotatably supported and fixed integrally therewith.

[Cleaning Means]

Figure 2:
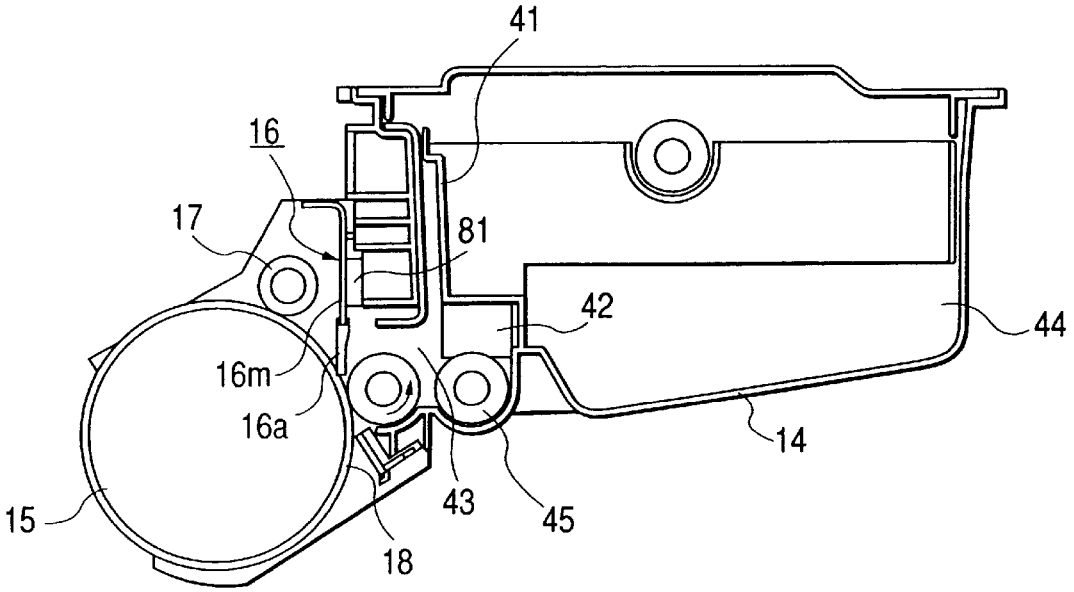
FIG. 2 is a cross-sectional view schematically showing the construction of an image bearing unit.

Cleaning means removes any toner remaining on the photosensitive drum 15 after the toner, visualized on the photosensitive drum 15 rotated counter-clockwisely as viewed in FIG. 2 by the developing means, has been transferred to the intermediate transfer member 9. Thereafter, the waste toner thus removed is stored in the container 14. The quantity of the waste toner stored in the container 14 does not fill the container 14 earlier than the end of the life of the photosensitive drum 15, and accordingly, the container 14 is interchanged simultaneously and integrally with the interchange of the photosensitive drum 15 at the end of its life.

Figure 3:
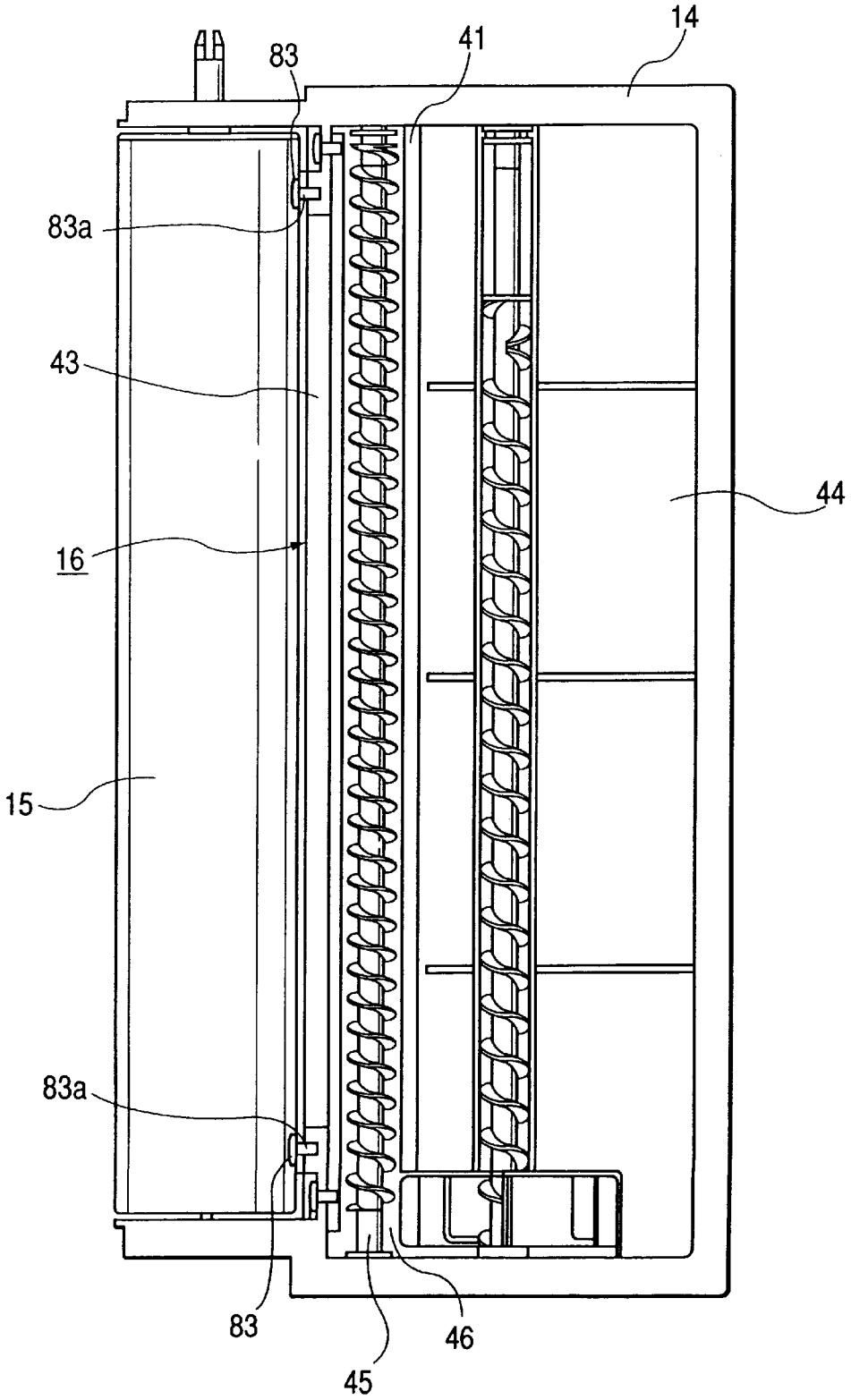
FIG. 3 is a top plan view of the image bearing unit.

The cleaning means will now be described in greater detail with reference to FIGS. 2 and 3. The container 14 has mounted therein a plate-shaped cleaning blade 16 comprised of an elastic member for removing the waste toner on the photosensitive drum 15, and is provided with a partition wall 41 which bisects the interior thereof into a cleaning chamber 43 and a toner accumulating chamber 44. The container 14 is generally formed of a resin material. The cleaning blade 16 is comprised of a highly rigid supporting member 16*m*, such as a metal plate, and a contacting portion 16*a* provided on the distal end thereof and having elasticity, such as rubber, and this contacting portion 16*a* bears against the photosensitive drum 15 in a counter direction. A rotated screw 45 is disposed near the partition wall 41, and by this screw 45, the waste toner is moved (conveyed) parallel to the longitudinal direction of the photosensitive drum 15. An opening portion 46 is provided in the partition wall 41 near the conveyance terminal of the screw 45, and a pressure wall 42 of a predetermined length is provided near this opening portion 46 so as to surround the outer periphery of the screw 45.

First, the container 14 removes the residual toner remaining on the photosensitive drum 15 after transfer by the cleaning blade 16. This residual toner (waste toner) after the transfer falls to near the opening portion of the cleaning chamber 43, which is adjacent to the photosensitive drum and piles there. Below the opening portion, a dip sheet 18 abuts against the photosensitive drum 15 at a certain angle. The toner on the photosensitive drum 15 slips through under this abutting dip sheet 18 and goes into the cleaning chamber 43 and piles there.

When the toner which has piled, reaches the vicinity of the screw 45, the screw 45 operates to carry the toner parallel to the longitudinal direction of the photosensitive drum 15 by the rotation thereof. The opening portion 46 of the partition wall 41, which is of such a shape that it contacts the range of rotation of the screw 45 and bisects the container 14, is located at the terminal of the screw 45 in the toner conveying direction thereof, and the pressure wall 42 exists so as to surround the outer periphery of the screw 45 and therefore, the sent toner becomes high in its powder pressure in the pressure wall 42 and goes into the toner accumulating chamber 44 through the opening portion 46 of the partition wall 41. The spiral screw 45 is formed by molding, whereas this is not restricting, but the screw 45 will suffice if it is spiral. For example, it may be formed of a metal such as a spring coil. At this time, the pressure wall 42 surrounds the screw 45 by a certain length and therefore it becomes back flow preventing means, and even if during the use of the image bearing unit, for example, during the interchange of other unit or during the cleaning of the main body, it is detached from the main body, the toner piling in the toner accumulating chamber 44 will not splash on the cleaning means. A method of fixing the cleaning member (cleaning blade) according to the present invention will be described later in detail.

[Feeding Portion]

The feeding portion feeds the transfer material 2 to the image forming portion, and is comprised chiefly of a cassette 1 containing a plurality of transfer materials 2 therein, a pickup roller 3, a feed roller 4, a double feed preventing retard roller 5, a feeding guide 6, registering rollers 8, etc.

During image formation, the pickup roller 3, the feed roller 4 and the retard roller 5 are rotatively driven in conformity with the image forming operation, and separate and feed the transfer materials 2 in the cassette 1 one by one, and guide them by the guide 6, and the transfer materials 2 come to the registering rollers 8 via a conveying roller 7.

During the image forming operation, the registering rollers 8 perform the non-rotating operation of making the transfer material 2 rest and wait and the rotating operation of conveying the transfer material 2 toward the intermediate transfer member 9 at a predetermined sequence, and effect the alignment of the image and the transfer material 2 during the transferring step which is the next step.

[Transferring Portion]

The transferring portion comprises an oscillatable transfer roller 10 which, in turn, comprises a metallic shaft having medium-resistance elastic foam wound thereon, and which is vertically movable and has a drive.

During the time when toner images of four colors are being formed on the intermediate transfer member 9, that is, during the time when the intermediate transfer member 9 is rotated a plurality of times, the transfer roller 10 is located below and is separate from the intermediate transfer member 9 as indicated by solid line in FIG. 1 so as not to disturb those images.

Figure 4:
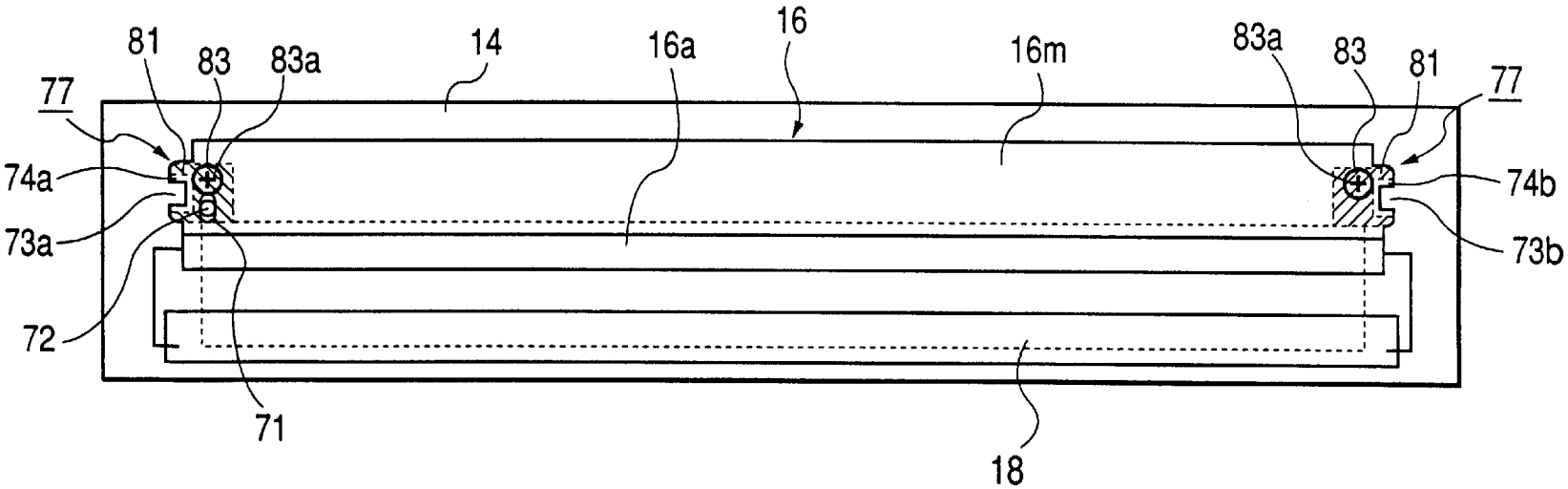
FIG. 4 is a plan (front) view of the image bearing unit.
Figure 6:
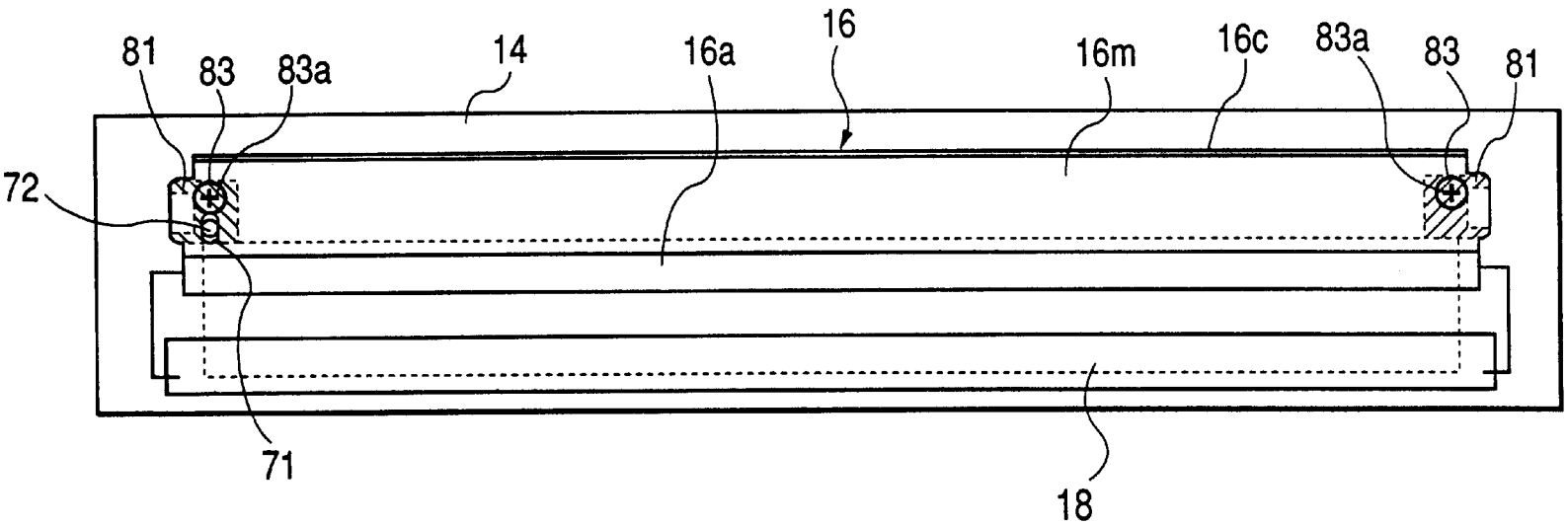
FIG. 6 is a plan (front) view of the image bearing unit.

After the toner images of four colors have been formed on the intermediate transfer member 9, the transfer roller 10 is urged toward an upper position indicated by the broken line in FIG. 4, i.e., against the intermediate transfer member 9 with predetermined pressure with the transfer material 2 therebetween by a cam member, not shown, in timed relationship with the transfer of the color images to the transfer material 2. At the same time, a bias is applied to the transfer roller 10 and the toner images on the intermediate transfer member 9 are transferred to the transfer material 2.

Since the intermediate transfer member 9 and the transfer roller 10 are driven, the transfer material 2 nipped between these two is conveyed leftwardly as viewed in FIG. 1 at a predetermined speed while being subjected to the transferring step, and is sent toward a fixing portion 25, which is the next step.

[Fixing Portion]

The fixing portion 25 heats and fixes the toner image formed on the transfer material 2 through the intermediate transfer member 9 after the toner images have been formed by the developing means 20, 21. As shown in FIG. 1, the fixing portion 25 comprises a fixing roller 26 for applying heat to the transfer material 2, and a pressurizing roller 27 for urging the transfer material 2 against the fixing roller 26, and each of these rollers is a hollow roller. These rollers have heaters 28 and 29 provided therein, and are designed to be rotatively driven to convey the transfer material 2 at the same time.

That is, the transfer material 2 holding the toner image thereon is conveyed by the fixing roller 26 and the pressurizing roller 27 and has heat and pressure applied thereto, whereby the toner is fixed on the transfer material 2.

[Method of Fixing the Cleaning Member]

Figure 5:
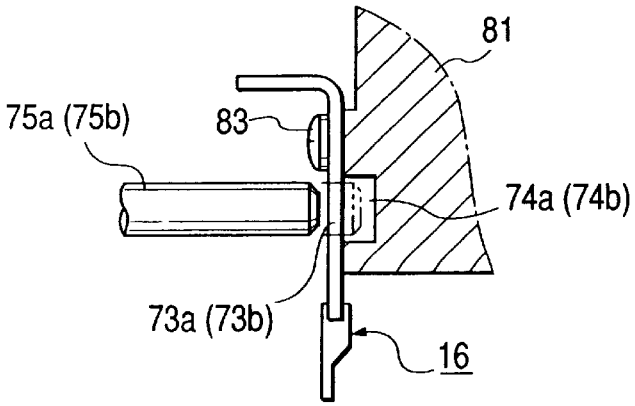
FIG. 5 is a cross-sectional view of essential portions showing an adjusting and assembling method for a cleaning member.

A method of fixing the cleaning member (cleaning blade) according to the present invention will now be described in detail with reference to FIGS. 4 and 5. The supporting member 16*m* of the cleaning blade 16 is fixed to the mounting surface 81 of the container 14 by fixing members 83 such as screws, through screw-cramping holes formed in the opposite ends thereof so that the elastic contacting portion 16*a* of the cleaning blade 16 may abut against the photosensitive drum 15 with a predetermined inroad amount. The supporting member 16*m* of the cleaning blade 16 is formed with a positioning elongated hole 71, slit, or slot which prevents movement in the longitudinal direction and yet permits the movement in the lateral direction, and the container 14 is formed with a pin 72 engaged with the elongated hole 71 and permitting the movement in the lateral direction. By this elongated hole 71 and the pin 72 being engaged with each other, the movement of the cleaning blade 16 in the longitudinal direction thereof is regulated and at the same time, the movement thereof in the lateral direction, which is a direction for setting the inroad amount relative to the photosensitive drum 15, becomes possible within a predetermined range.

Also, there is provided adjusting means 77 for adjusting the movement of the cleaning blade 16 in the lateral direction when setting the inroad amount of the cleaning blade 16 relative to the photosensitive drum 15. This adjusting means 77 comprises cut-away portions 73*a*, 73*b* provided on the longitudinally opposite end portions of the cleaning blade 16, pins 75*a*, 75*b* fitted in the cut-away portions 73*a*, 73*b*, and relieved portions 74*a*, 74*b* provided on the longitudinally opposite end portions of the container 14 and permitting the entry of the pins 75*a*, 75*b* fitted in the cut-away portions 73*a*, 73*b*. The relieved portions 74*a*, 74*b*, as shown in FIG. 5, are formed to a size somewhat larger than the cut-away portions 73*a*, 73*b* to permit the entry of the pins 75*a*, 75*b*.

In the above-described construction, the cleaning blade 16 is fixed by the following method. First, the elongated hole 71 of the cleaning blade 16 is engaged with the pin 72 of the container 14 to thereby effect the positioning which prevents the movement of the cleaning blade 16 in the longitudinal direction and yet permits the movement thereof in the lateral direction. From this state, as shown in FIG. 5, the pins 75*a*, 75*b* for moving the cleaning blade are inserted into the cut-away portions 73*a*, 73*b*, and the pins 75*a*, 75*b* are moved in the lateral direction of the cleaning blade 16 until a predetermined inroad amount is reached while the inroad amount of the cleaning blade 16 relative to the photosensitive drum 15 is read by a tool, not shown. Since the container 14 is formed with the aforedescribed relieved portions 74*a*, 74*b*, the pins 75*a*, 75*b* are movable within the range of these relieved portions 74*a*, 74*b*. After the inroad amount of the cleaning blade 16 relative to the photosensitive drum 15 has reached a predetermined inroad amount, the cleaning blade 16 is fixed to the mounting surface 81 of the container 14 by the fixing members 83, such as screws through screw-cramping holes 83*a*.

By the above-described construction, assembly can be accomplished while the cleaning blade 16 is moved in the lateral direction and the inroad amount thereof relative to the photosensitive drum 15 is adjusted to a predetermined set value, and the stable setting condition and further, cleaning performance of the cleaning blade 16 can be obtained, and images of high quality can always be provided to the user.

Also, as shown in FIG. 4, by adopting a construction in which the adjusting means 77 are located longitudinally outwardly of the fixing members 83 for fixing the cleaning blade 16 to the container 14, there is no fear for a reduction in the strength of the cleaning blade 16 attributable to a reduction in the strength of the supporting member 16*m* by the cutaway portions.

In the present embodiment, the rotational torque of the photosensitive drum 15 is about 15 kgf-cm at greatest, but by effecting the fastening of the fixing members 83 such as screws at the fastening torque of 6 to 8 kgf-cm, the initial setting (the inroad amount of the cleaning blade 16 relative to the photosensitive drum 15) did not change even after a durability test.

Also, in the present embodiment, the construction in which the cut-away portions 73*a*, 73*b* are provided at the opposite ends of the supporting member 16*m* of the cleaning blade 16 has been exemplified, but this is not restrictive. Thus, for example, holes into which the pins 75*a*, 75*b* are fitted may be provided if they are provided in the opposite end portions of the supporting member 16*m* at a time.

Also, in the above-described embodiment, the tool pins 75*a*, 75*b* are fitted in the cut-away portions 73*a*, 73*b* provided in the opposite ends of the supporting member 16*m* of the cleaning blade 16 to thereby move the cleaning blade 16 in the lateral direction, but this is not restrictive. As shown, for example, in FIG. 6, it is also possible to provide a grip portion 16*c* on the supporting member 16*m*, and grasp it by a tool and move the cleaning blade 16 likewise in the lateral direction of the blade member.

[Second Embodiment]

Figure 7:
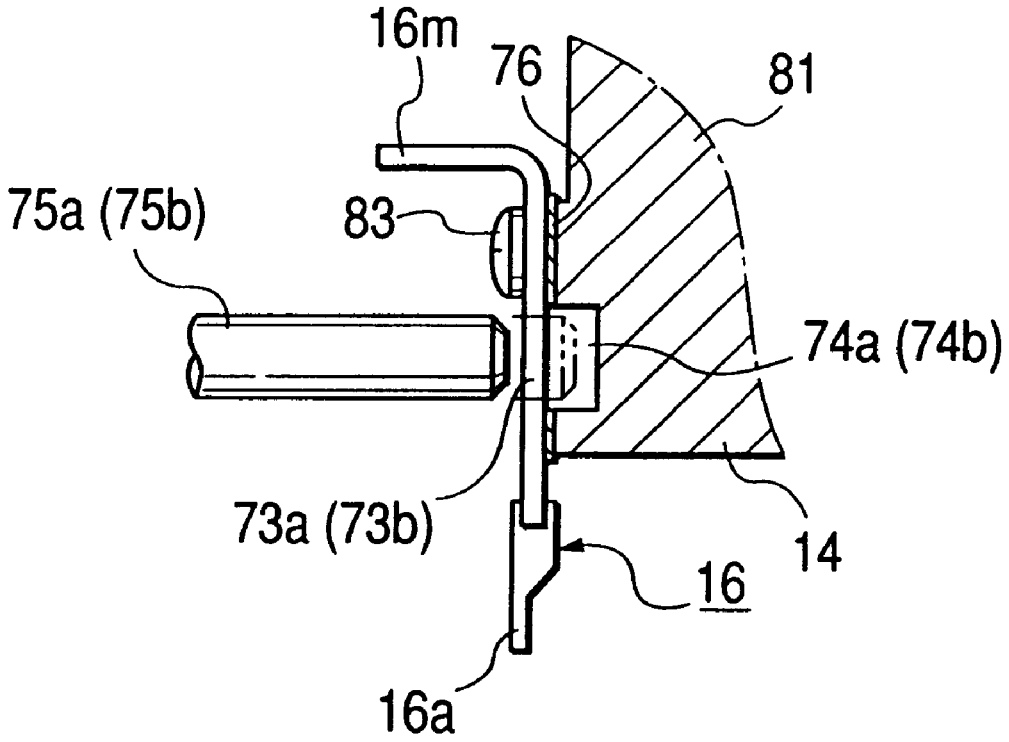
FIG. 7 is a cross-sectional view of essential portions showing an adjusting and assembling method for a cleaning member.

A color image forming apparatus on which a process cartridge according to a second embodiment is detachably mountable will now be described in detail with reference to FIG. 7. The schematic construction of the entire apparatus is substantially similar to that of the aforedescribed first embodiment and therefore, members having like functions are given the same reference characters and need not be described in detail. The reinforcing construction of the cleaning portion which is the feature of the present embodiment will hereinafter be described.

When for example, the coefficients of linear expansion of the container 14 and the supporting member 16*m* of the cleaning blade 16 differ greatly from each other, warping is produced in the supporting member 16*m* by the so-called bimetal effect so that the length of the supporting member is changed by the influences of the fluctuation of the environment, the temperature rise of the image forming apparatus, etc., and the setting of the inroad amount of the cleaning blade 16 may go wrong.

So, in the present embodiment, a slidable member 76 such as a PET sheet or a PTFE sheet, whose surface has a slippery characteristic, is interposed between the mounting surface 81 of the container 14 and the supporting member 16*m* of the cleaning blade 16 to thereby effect the fixing thereof.

According to the construction of the present embodiment, in addition to the effect described in the aforedescribed first embodiment, the fluctuation of the inroad amount of the cleaning blade 16 due to the aforementioned longitudinal warp thereof by heat or the like can be suppressed by interposing the slidable member 76, and it becomes possible to further improve the cleaning performance.

[Other Embodiments]

In the aforedescribed embodiments, there has been exemplified a construction in which the cleaning member is provided with a positioning elongated hole to regulate the movement of the cleaning member in the longitudinal direction and yet permit the movement thereof in the lateral direction and the frame is provided with a projection engaged with the positioning elongated hole, but the present invention is not restricted thereto. There may be adopted a construction in which for example, the frame is provided with a positioning elongated hole and the cleaning member is provided with a projection engaged with the positioning elongated hole.

Also, in the aforedescribed embodiments, an image bearing unit detachably mountable on the main body of the apparatus has been exemplified and described as the process cartridge, but the present invention is not restricted thereto. The present invention can also be applied to a cartridge in which for example, the image bearing member, the charging means, the developing means and the cleaning means are made integral with one another to thereby obtain a similar effect.

Also, an electrophotographic photosensitive member has been exemplified as the image bearing member, but use may be made of such a member receiving toner images from the photosensitive member as the intermediate transfer member 9 of FIG. 1.

Also, a printer has been exemplified as the image forming apparatus, but the present invention is not restricted thereto. There may be used other image forming apparatus, such as a copying apparatus, a facsimile apparatus or a word processor, and further the invention can be applied to not only a color-type image forming apparatus, but also a monochromatic-type image forming apparatus to obtain a similar effect.

As described above, according to the present invention, even when it is necessary to keep the setting condition of the cleaning member more highly accurate than before, assembly can be accomplished while the cleaning member is moved in the lateral direction thereof to thereby adjust the inroad amount thereof relative to the image bearing member to a predetermined set value and therefore, even the delicate setting of the inroad amount becomes possible, and the stable setting condition and further, cleaning performance of the cleaning member can be obtained, and it becomes possible to always provide images of high quality to the user.

What is claimed is:

1. A method of mounting a cleaning member in a process cartridge, wherein the cleaning member to be mounted in the process cartridge has a plate-shaped elastic blade mounted on one end of a supporting plate made of a metal, said plate-shaped elastic blade rubbing against an electrophotographic photosensitive member, wherein said supporting plate has:

screw-cramping holes in the opposite ends of said supporting plate for fixing said supporting plate to the frame of said process cartridge;

cut-away portions for fitting and inserting thereinto pins for adjustably moving said supporting plate in a direction for adjustment when the mounting position is adjusted before said supporting plate is fixed to said frame; and a hole or slit in which a projection of the process cartridge is fitted to guide said supporting plate in an adjusting direction, said hole or slit being formed in at least one end of said supporting plate, wherein the frame of the process cartridge to which said cleaning member is mounted has:

relieved portions by a space permitting an entry of said fitted and inserted pins, near positions at which said pins are fitted and inserted during said adjustment; and said projection corresponding to a position of said hole or slit, and wherein during the adjustment of said mounting, with the projection fitted in the hole or slit for guide, the pins are fitted in said cut-away portions, and the cleaning member has its mounted position adjusted by said pins being moved, and after said cleaning member has been moved to a predetermined position, the opposite ends of said supporting plate are screw-cramped to thereby effect the positioning of the cleaning member.

2. A method according to claim 1, wherein a sheet having a slippery surface is interposed between the metallic supporting plate of said cleaning member and the frame of the cartridge, and said supporting plate is fixed to said frame.

3. A process cartridge detachably mountable to a main body of an image forming apparatus for forming an image by an electrophotographic method, said process cartridge comprising:

(a) an electrophotographic photosensitive member, and (b) a cleaning member for rubbing and removing residual toner remaining on said electrophotographic photosensitive member after a transferring step, said cleaning member having a plate-shaped elastic blade which rubs against said electrophotographic photosensitive member mounted on one end of a supporting plate made of a metal, said supporting plate having:

in the opposite ends thereof screw-cramping holes for fixing said supporting plate to a frame of the process cartridge, cut-away portions for fitting and inserting thereinto pins for adjustably moving said supporting plate in a direction for adjustment when the mounting position is adjusted before said supporting plate is fixed to said frame, and a hole or slit in which a projection of the process cartridge is fitted to guide said supporting plate in an adjusting direction, said hole or slit being formed in at least one end of said supporting plate, (c) the frame of the process cartridge to which said cleaning member is mounted having:

relieved portions by a space permitting an entry of said fitted and inserted pins, near positions at which said pins are fitted and inserted during said adjustment; and the projection corresponding to a position of said hole or slit, wherein when said cleaning member is to be mounted and adjusted to the frame of the process cartridge, with the projection fitted in the hole of slit for guide, the pins are fitted in said cut-away portions, and the cleaning member has its mounted position adjusted by said pins being moved, and after the cleaning member has been moved to a predetermined position, the opposite sides of said supporting plate are screw-cramped, whereby the positioning of said cleaning member is effected.

4. A process cartridge according to claim 3, wherein a sheet having a slippery surface is interposed between the metallic supporting plate of the cleaning member and the frame of the process cartridge.

5. An image forming apparatus for forming an image by an electrophotographic method comprising:

(a) an electrophotographic photosensitive member, and (b) a cleaning device having a cleaning member for rubbing and removing residual toner remaining on said electrophotographic photosensitive member after a transferring step, said cleaning member having a plate-shaped elastic blade which rubs against said electrophotographic photosensitive member mounted on one end of a supporting plate made of a metal, said supporting plate having:

in the opposite ends thereof screw-cramping holes for fixing said supporting plate to a frame of a cleaning device, cut-away portions for fitting and inserting thereinto pins for adjustably moving said supporting plate in a direction for adjustment when the mounting position is adjusted before said supporting plate is fixed to said frame; and a hole or slit in which a projection of the cleaning device is fitted to guide said supporting plate in an adjusting direction, said hole or slit being formed in at least one end of said supporting plate, (c) the frame of the cleaning device to which said cleaning member is mounted, having:

relieved portions by a space permitting an entry of said fitted and inserted pins, near positions at which said pins are fitted and inserted during said adjustment, and the projection corresponding to a position of said hole or slit, wherein when said cleaning member is to be mounted and adjusted to the frame of the cleaning device, with the projection fitted in the hole or slit for guide, the pins are fitted in said cut-away portions, and the cleaning member has its mounted position adjusted by said pins being moved, and after the cleaning member has been moved to a predetermined position, the opposite sides of said supporting plate are screw-cramped, whereby the positioning of said cleaning member is effected.

6. An image forming apparatus according to claim 5, wherein said cleaning device has a sheet having a slippery surface between the metallic supporting plate of the cleaning member and the frame of the cleaning device.

* * * * *

UNITED STATES PATENT AND TRADEMARK OFFICE

CERTIFICATE OF CORRECTION

PATENT NO. : 6,131,011

DATED : October 10, 2000

INVENTOR(S): HISAYOSHI KOJIMA, ET AL.

It is certified that error appears in the above-identified patent and that said Letters Patent is hereby corrected as shown below:

COLUMN 4:
Line 11, "the" should read --a--.

COLUMN 11:
Line 15, "plate," should read --plate, and--.
Line 26, "of should read --or--.

COLUMN 12:
Line 19, "plate," should read --plate, and--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*